United States Patent [19]

Stepansky

[11] 4,043,561

[45] Aug. 23, 1977

[54] PUZZLE AND METHOD OF PLAYING SAME

[76] Inventor: Daniel Marion Stepansky, 9801 S. Winchester, Chicago, Ill. 60643

[21] Appl. No.: 716,743

[22] Filed: Aug. 23, 1976

[51] Int. Cl.[2] ..... A63F 9/08

[52] U.S. Cl. ..... 273/153 P; 35/31 D

[58] Field of Search ..... 273/153 P; 35/31 R, 35/31 D, 31 F

[56] References Cited

U.S. PATENT DOCUMENTS

| | | | |
|---|---|---|---|
| 1,419,871 | 6/1922 | McDonald | 273/153 P UX |
| 2,738,979 | 3/1956 | Dalton | 273/153 P UX |

FOREIGN PATENT DOCUMENTS

| | | | |
|---|---|---|---|
| 177,097 | 12/1953 | Austria | 273/153 P |
| 178,218 | 4/1954 | Austria | 35/31 D |

*Primary Examiner*—Anton O. Oechsle
*Attorney, Agent, or Firm*—Bernard L. Kleinke

[57] ABSTRACT

A puzzle includes a set of graduated size markers, each one having a different whole number indicia thereon, the indicia including the numbers 2 through 6. A base has a set of five positions on the face thereof, and one of the positions is a starting position and has a starting indicia associated therewith. Another one of the positions is a finishing position and has a finishing indicia associated therewith. At least one other one of the positions is a limited position and has indicia associated therewith designating certain ones only but not all of the whole numbers 2 through 6. The markers are stacked in a vertical pile at the starting position, and they are then moved seriatum from the pile to other positions with smaller markers always being placed above larger markers according to the puzzle rules. Only those markers having corresponding number indicia as the number indicia of the limited position may be moved to the limited position. The markers are moved from the limited positions and the other positions to the finishing position with smaller markers always being placed above larger markers according to the puzzle rules. The limited positions may be positions bearing indicia for prime numbers only, numbers which are a multiple of 3 only, or numbers which are multiples of 2 only.

10 Claims, 3 Drawing Figures

PUZZLE AND METHOD OF PLAYING SAME

The present invention relates in general to a puzzle and a method of playing same, and it more particularly relates to a puzzle and a method of playing it, which puzzle includes a series of graduated size markers which may be stacked in a pile and which are arranged at a position on a base and movable to other positions thereon.

Transfer puzzles have been known in the art, and they include a set of graduated size markers, such as annular discs, adapted to be stacked in a vertical pile on a series of posts extending from a base. The object of the puzzle is to transfer the pile of markers from the starting position to a finishing position by moving the markers seriatum, while always placing a smaller marker on top of a larger marker. For example, reference may be made to the following U.S. Pat. Nos. 983,730; 2,595,938; and 2,738,979. While the foregoing-mentioned puzzles and games may be satisfactory for some applications, it would be highly desirable to have such a puzzle which is not only entertaining, but also is educational at the same time. Such a puzzle could be used for teaching mathematical concepts. Also, such a puzzle should be usable by a wide range of ages, including younger children.

Therefore, the principal object of the present invention is to provide a new and improved puzzle and a method of playing it, the puzzle being of an educational nature and being useful in the learning of mathematical concepts.

Another object of the present invention is to provide such a new and improved puzzle and a method of playing it, the puzzle being inexpensive to manufacuture and being suitable for users of a wide range of ages, such users including young children.

Briefly, the above and further objects of the present invention are realized by providing a method of playing a puzzle which includes a set of graduated size markers, each one having a different whole number indicia thereon, the indicia including the numbers 2 through 6. A base having a set of five positions on the face thereof has one of the positions designated as a starting position by having a starting indicia associated therewith. Another one of the positions is designated as a finishing position and has finishing indicia associated therewith. At least one other one of the positions is a limited position and has indicia designating certain ones only but not all of the whole numbers 2 through 6. The markers are stacked in a vertical pile at the starting position, and they are moved seriatum from the pile to other positions with smaller markers always being placed above larger markers according to the puzzle rules. Only those markers having corresponding number indicia as the number indicia of the limited position may be moved to the limited position in accordance with the puzzle rules. The markers are moved from the limited position and the other positions to the finishing position with smaller markers always being placed above larger markers according to the puzzle rules. There may be a total of three limited positions. One of the limited positions would have indicia indicating prime numbers only, another one of the positions would have indicia indicating numbers which are a multiple of 2 only, and the third limited position has indicia designating numbers which are multiples of 3 only. In this last regard, such an arrangement enables the user to learn certain basic mathematical concepts.

As a result, the puzzle and method of playing it according to the present invention enables the user to gain a great deal of satisfaction and entertainment. Also, at the same time, the user is able to learn certain basic mathematical concepts, such as a few of the prime numbers which are necessary in elementary and high school work for mathematical concepts such as adding fractions, factoring, and in simplifying radicals. Additionally, the user is able to learn the concept of multiples of 2 and 3, and thus the meaning of the concept of multiples. Also, the user develops spacial reasoning of topology as well as improving logical reasoning by foreseeing the correct combination of moves in advance of moving the markers. Moreover, the puzzle user may be of an age of about 8 years old to adult. The beginner can use, for example, five markers, and then progressively add additional markers as his age and skill increases. For young children, instead of using, for example, the prime number notations, the actual prime numbers may be associated with the positions so that the young user can know what numbers are permitted at the various positions.

The above, and still further highly important objects and advantages of the invention will become apparent from the following detailed specification, appended claims, and attached drawings, wherein:

Figure 1:
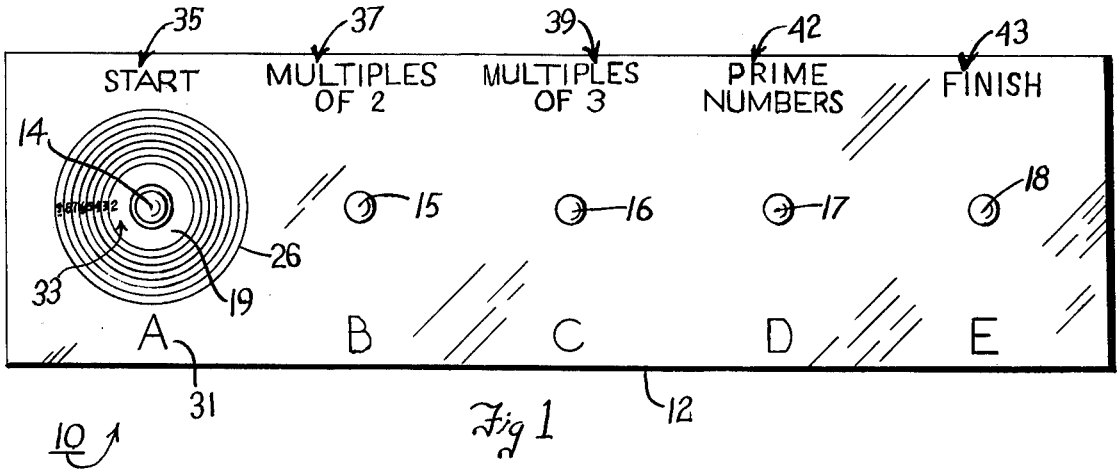
FIG. 1 is a plan view of a puzzle constructed in accordance with the present invention.
Figure 2:
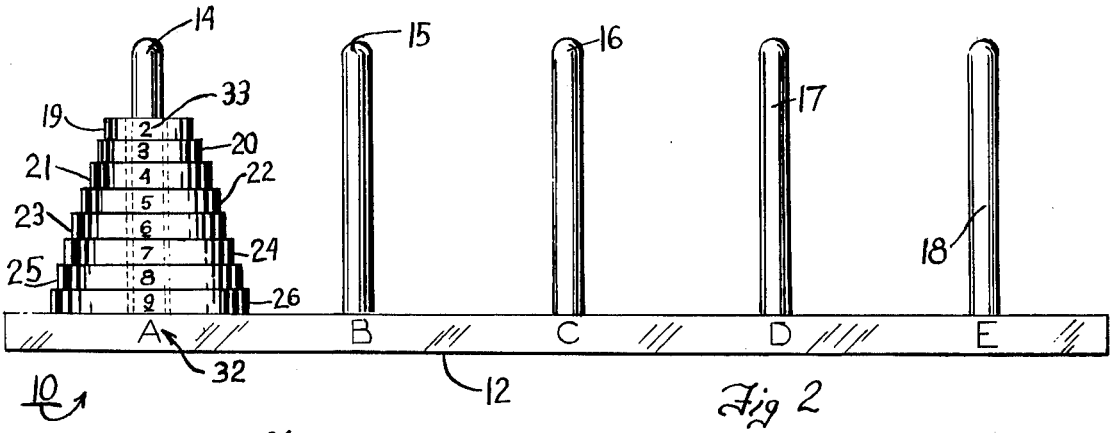
FIG. 2 is an elevational view of the puzzle of FIG. 1.
Figure 3:
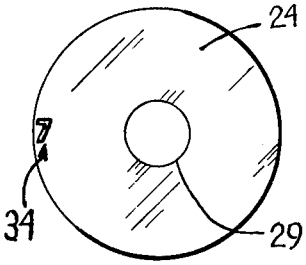
FIG. 3 is an enlarged face view of one of the markers of the puzzle of FIG. 1.

Referring now to the drawings, and more particularly to FIGS. 1 and 2 thereof, there is shown a puzzle 10, which is constructed in accordance with the present invention and which is adapted to be used in accordance with the method of playing a puzzle in accordance with the present invention. The puzzle 10 generally comprises a flat rectangular base 12 having a series of five upstanding posts 14 through 18, and a set of eight markers 19 through 26, each of which has a hole, such as the hole 29 in the marker 24 as shown in FIG. 3 of the drawings, whereby the markers 19 through 26 may be stacked in a vertical pile on one of the posts, such as the post 14. Each one of the posts 14 through 18 serves to provide a position for the markers. The markers are graduated in size, and according to the puzzle rules, the markers are moved seriatum from one post to another but a smaller marker must be placed on top of a larger marker and a larger marker may never be placed on the top of a smaller marker in accordance with the game rules.

A set of letter indicia, such as the indicia 31, are disposed on the upper face of the base 12 adjacent the corresponding posts 14 through 18 to designate the different posts. The letter indicia are the letters A through E for the corresponding posts 14 through 18. Similar indicia, such as the letter indicia 32 are disposed near a corresponding post 14 through 18 on the side edge of the base 12 so as to more readily identify the posts. A set of number indicia, such as the indicia 33, are disposed on the side edge of the markers to individually identify them. Such number indicia comprise the whole numbers 2 through 9, the number 2 indicia being disposed on the side edge of the smallest marker, and the number indicia increase as the size of the marker increases until the number 9 is used with the largest marker 26. Similarly, a set of the corresponding same number indicia, such as the indicia indicated at 34, on the marker 24, are disposed on the faces of the markers to help facilitate the recognition of the identity of the marker, since a number indicia appears both on the face and the side edge thereof, both number indicia being identical for each one of the markers. In accordance with the present invention, for the purpose of enabling the user to see at a glance the number indicia of all of the markers while looking down on the markers from above them, the number indicia, such as the indicia indicated at 34 on the face of the marker 24, are disposed adjacent the outer periphery of the markers spaced radially from the holes therein by a radial distance which is greater than the radius of the next smallest marker. Thus, the number indicia on all of the faces of the markers are always clearly visible to the user without the necessity of having to manipulate the markers. The ability of always being able to see all of the number indicia at a glance is important, because the user should be able to plan the moves in advance. This ability adds greatly to the enjoyment of the puzzle.

An indicia indicated at 35 is disposed on the upper face of the base 12 near the post 14 and denotes the word START. As a result, the post 14 is the starting position for the puzzle, and the markers 19 through 26 are stacked in a vertical pile on the post 14 at the beginning of the playing of the puzzle. An indicia indicated at 37 is disposed on the upper face of the base 12 near the post 15 and denotes the words MULTIPLES OF 2. According to the puzzle rules, this indicia 37 indicates that only those discs bearing a numerical indicia which is a multiple of 2 may be placed at the position post 15. Thus, the post 15 is a limited position, since only certain ones of the markers may be moved to that position as long as those markers are designated with the numbers 2, 4, 6 and 8.

As indicia indicated at 39 is also disposed on the upper surface of the base 12 adjacent the post 16 and indicates the words MULTIPLES OF 3. According to the puzzle rules, the indicia 39 indicates to the user that only those markers bearing a numerical indicia which is a multiple of 3 may be moved to the position post 16. Thus, the position post 16 is a limited position, and only the markers indicated with numbers 3, 6 and 9 may be moved thereto. An indicia generally indicated at 42 is disposed on the upper face of the base 12 adjacent the post 17 and indicates the words PRIME NUMBERS. The indicia 42 in accordance with the puzzle rules alert the user that only those markers bearing prime number indicia may be moved to the position post 17. Thus, the position post 17 is a limited position in a similar manner as the posts 15 and 16, since only markers designated with numbers 2, 3, 5 and 7 may be moved to position post 17.

An indicia generally indicated at 43 is also disposed on the upper face of the base 12 adjacent the post 18 and indicates the words FINISH. According to the puzzle rules, the indicia 43 designates the position at which all of the markers must be stacked in a vertical pile in a similar manner as the pile of markers shown in FIGS. 1 and 2 of the drawings at post 14. According to the game rules, any one of the markers may be transferred to the position post 14 and 18, since they are unlimited positions.

The markers are in the form of rigid annular discs, each one having a central aperture or hole to receive the posts so that the discs may be slipped over the posts and either rested on the base 12 or on the uppermost disc surrounding that same post.

In order to understand the solution to the puzzle using the eight markers, the following is a sequence of moves which may be undertaken to solve the puzzle (the number indicating the marker and the letter indicating the post): 2E, 3D, 4B, 2B, 5E, 6C, 7D, 5D, 2D, 4E, 8B, 4B, 9E, 4A, 8E, 4B, 2B, 5A, 7E, 3D, 6E, 5E, 2A, 4E, 3E and 2E. This sequence indicates the series of moves to be made by the markers to establish the desired result in the minimum number of moves.

While the present invention has been described in connection with a particular embodiment thereof, it will be understood that many changes and modifications of this invention may be made by those skilled in the art without departing from the true spirit and scope thereof. It is to be understood that while different types and kinds of materials may be employed with the base and markers, wood or plastic is preferred. Similarly, different shapes for the markers may be employed. Also, in place of posts, indicia or other indications on the base may be employed. Accordingly, the appended claims are intended to cover all such changes and modifications as fall within the true spirit and scope of the present invention.

What is claimed is:

1. A puzzle, comprising:

a flat base having a face;

means defining a series of five positions on said face;

a set of N number of graduated size markers adapted to be stacked in a vertical pile at said positions on said base;

means defining different single number indicia including a group of whole numbers two through six individually on different ones of said markers to identify each marker individually; and means defining limited indicia designating certain ones only of said whole numbers but not all of said whole numbers of said group being disposed at least one of said positions to indicate that only said markers having the same numerical indicia thereon may be moved to the last-mentioned position in accordance with the puzzle rules.

2. A puzzle according to claim 1, wherein said means defining different single number indicia are disposed near the periphery of the markers on the faces thereof beyond the periphery of the next smallest marker so that all of said number indicia are clearly visible to the user at a single glance.

3. A puzzle according to claim 1, wherein said limited indicia comprises prime whole numbers.

4. A puzzle according to claim 1, wherein said limited indicia comprises multiples-of-two numbers.

5. A puzzle according to claim 1, wherein said limited indicia comprises multiples-of-three numbers.

6. A puzzle according to claim 5, further including means defining second limited indicia designating prime numbers of said whole numbers of said group and being disposed at still another one of said positions.

7. A puzzle according to claim 6, further including means defining third limited indicia designating multiples-of-two numbers of said whole numbers of said group and being disposed at yet another one of said positions.

8. A puzzle according to claim 1, wherein said markers are each annular discs.

9. A method of playing a puzzle, comprising:

providing a set of graduated size markers, each one having a different whole number indicia thereon, said indicia including the numbers two through six;

providing a base having a set of five positions on the face thereof, one of said positions being a starting position and having starting indicia, another one of said positions being a finishing position and having finishing indicia, at least one other one of said positions being a limited position and having limited indicia designating certain ones only but not all of said whole numbers two through six;

stacking said markers in a vertical pile at the starting positions;

moving said markers seriatum from said pile to other positions with smaller markers always being placed above larger markers according to puzzle rules;

moving to the limited position only those markers having corresponding number indicia according to puzzle rules; and moving markers from the limited position and the other positions to the finishing position with smaller markers always being placed above larger markers according to puzzle rules.

10. A method according to claim 9, wherein said indicia comprises prime whole numbers.

* * * * *